US007040362B1

(12) United States Patent
Monuik et al.

(10) Patent No.: US 7,040,362 B1
(45) Date of Patent: May 9, 2006

(54) LOG SPLITTER

(76) Inventors: Darryl James Monuik, 8727-33 Ave. N.W., Calgary, AB (CA) T3B 1M2; Ritchie John Monuik, 7631-35 Ave. N.W., Calgary, AB (CA) T3B 1T4

( * ) Notice: Subject to any disclaimer, the term of this patent is extended or adjusted under 35 U.S.C. 154(b) by 70 days.

(21) Appl. No.: 10/844,724

(22) Filed: May 14, 2004

(51) Int. Cl.
*B27L 7/06* (2006.01)

(52) U.S. Cl. ..... 144/193.2; 144/195.8; 144/195.7; 173/30; 173/53

(58) Field of Classification Search ..... 144/193.1, 144/193.2, 194, 195–195.9; 173/30, 53, 173/90, 91, 92; 254/104
See application file for complete search history.

(56) References Cited

U.S. PATENT DOCUMENTS 4,244,407 A * 1/1981 McMullin ..... 144/195.4
4,262,714 A * 4/1981 Pratt et al. ..... 144/195.1
4,782,867 A * 11/1988 Forsyth ..... 144/195.2
5,535,795 A * 7/1996 Bunn ..... 144/195.4
5,575,319 A * 11/1996 Chick ..... 144/195.4

* cited by examiner

*Primary Examiner*—Derris H. Banks
*Assistant Examiner*—Shelley Self
(74) *Attorney, Agent, or Firm*—G. F. Gallinger

(57) ABSTRACT

A log splitter comprising: a base; a lever having one end portion hingably attached to the base; a wedge slidably attached to a hinged end portion of the lever, to slidably reciprocate along the lever when the lever is swung; a log support for a cut log; and, an upper end log restraint slidably positioned on the lever, said log restraint having a pawl, and the lever having teeth therealong, so that the log restraint can only slide towards the cut log. When the lever is swung down the wedge is forced into the cut log, and when the lever is lifted the wedge is slidably pulled back along the lever thereby pulling the now partially split log so that the upper end log restraint freely slides along the lever. When the lever is again pushed downwardly the cycle is repeated. The lever may be pushed with a foot pedal.

10 Claims, 1 Drawing Sheet

LOG SPLITTER

FIELD OF THE INVENTION

This invention relates to log splitters having a mechanically levered arm. More particularly this invention relates to a mechanically levered log splitter employing a ratchet so that a wedge is automatically incrementally advanced into a log with reiterative cyclical movements of the lever.

BACKGROUND OF THE INVENTION

Forcing a wedge into an end of a cut log requires much force. Splitting a log with an axe is unsafe. There is much need for a log splitter which can be slowly and forcefully advanced into an end of a cut log in a controlled manner. There is also a need for a mechanism which maintains the cut log in an aligned position.

Many inventors have devised mechanisms which are levered so that individuals may multiply their arm strength to force a wedge into a log. All of these mechanisms require that the cut log be stood and balanced on one of its ends until the wedge is seated on the other opposite top end portion. One problem with this approach is that if the cut log is not squarely cut off on the lower end it will be difficult to maintain the log in an upright position. If the log is not cut squarely on the upper end the log may laterally slide out beneath the advancing wedge. Another limitation of these log splitters is that the force the individual applies to the lever is their arm force.

U.S. Pat. No. 5,575,319 issued to Charles T. Chick and U.S. Pat. No. 4,244,407 issued to J. L. McMullin both utilize a jack or ratchet device in conjunction with a mechanical lever arm. One problem with both of these devices is that the lever and jack or ratchet device are independently operated with different levers. Another problem with these devices is that the levers are operated with ones arms. This limits the force which can be exerted on the lever to the sustained strength of the arms. Yet a further problem with these devices is that they lack a means to hold the cut logs in an aligned position for splitting. The logs must be balanced beneath the wedge before the wedge engages the cut log.

OBJECTS OF THE INVENTION

It is an object of this invention to disclose a log splitter which utilizes a lever to incrementally advance a wedge into a cut log and a ratchet which automatically advances so that a cyclical motion of a single lever automatically advances the lever into and through the cut log. It is yet a further object of this invention to disclose a log splitter which laterally maintains a cut log in a stable position to facilitate safer loading, easier loading and automatic positioning of the cut log to result in a central longitudinal split therethrough. It is yet a final object of this invention to disclose a log splitter which is operational by use of one's leg, rather than by use of one's arms so that a greater force can be applied to split a cut log with substantially less relative exertion.

One aspect of this invention provides for a log splitter for splitting a cut log comprising: a) a base; b) a lever having one end portion hingably attached to one end portion of the base and said lever having an opposite swinging end portion; c) a wedge slidably attached to a hinged end portion of the lever configured to slidably reciprocate along the lever when the swinging end portion of the lever is swung down and up; d) a log support carried by the lever to longitudinally support the cut log when the log is positioned thereon; and, e) an upper end log restraint slidably positioned on the swinging end portion of the lever, said log restraint having a pawl, and the swinging end portion of the lever having teeth therealong to engage the pawl, so that the log restraint can slide along the lever only towards the cut log. When the lever is swung down the wedge is forced into an end portion of the cut log, and when the lever is lifted the wedge is slidably pulled back along the lever thereby pulling the now partially split log down the lever so that the upper end log restraint freely slides down and along the lever. This positions the wedge to advance further into the now partially split cut log when the lever is again pushed downwardly, repeating the cycle.

In a preferred aspect of this invention a foot pedal attached to the swinging end portion of the lever so that the lever may be forced downwardly with one's foot.

Various other objects, advantages and features of this invention will become apparent to those skilled in the art from the following description in conjunction with the accompanying drawings.

FIGURES OF THE INVENTION

Figure 1:
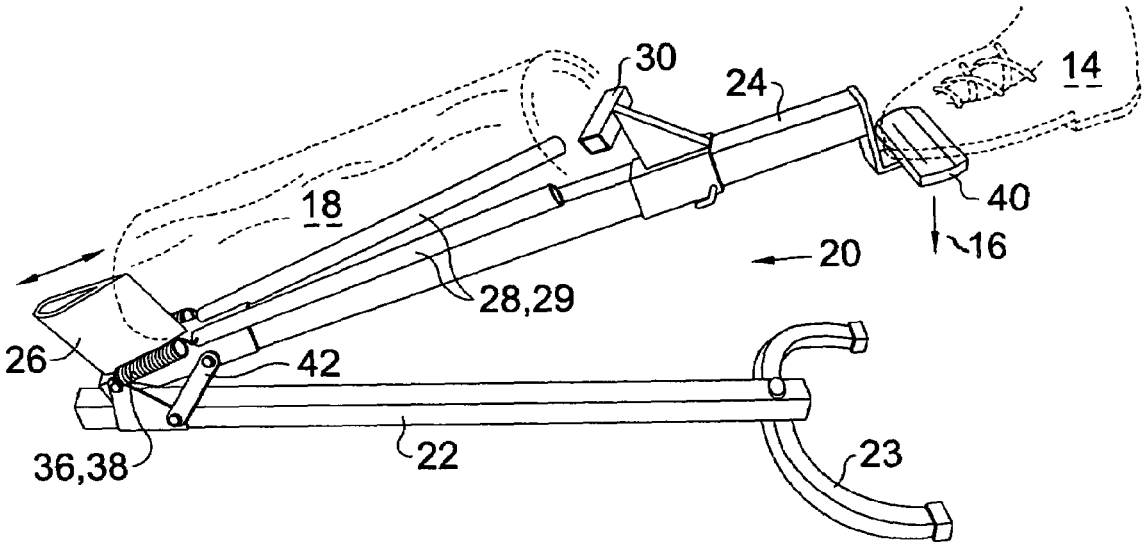
FIG. 1 is a perspective view of a log splitter having a foot operated lever which automatically advances a wedge into a cut log with a cyclical motion of the lever.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a log splitter 20 having a foot operated lever 24 which automatically advances a wedge 26 into a cut log 18 with a cyclical motion of the lever 24. Most generally, the log splitter 20 for splitting a cut log 18 comprises: a) a base 22; b) a lever 24 having one end portion hingably attached to one end portion of the base 22, and said lever 24 having an opposite swinging end portion; c) a wedge 26 slidably attached to a hinged end portion of the lever 24 configured to slidably reciprocate along the lever 24 when the swinging end portion of the lever 24 is swung down and up; d) a log support 28 carried by the lever 24 to longitudinally support the cut log 18 when the cut log 18 is positioned thereon; e) an upper end log restraint 30 slidably positioned on the swinging end portion of the lever 24, said log restraint 30 having a pawl 32, and the swinging end portion of the lever 24 having teeth 34 therealong to engage the pawl 32. Then the upper end log restraint 30 can slide along the lever 24 only towards the cut log 18. When the lever 24 is swung down the wedge 26 is forced into an end portion of the cut log 18, and when the lever 24 is lifted the wedge 26 is slidably pulled back along the lever 24 thereby pulling the now partially split log 18 down the lever 24 so that the upper end log restraint 30 freely slides down and along the lever 24; thereby positioning the wedge 26 to advance further into the now partially split cut log 18 when the lever 24 is again pushed downwardly, repeating the cycle.

In the most preferred aspect of this invention the log splitter 20 further comprises an interconnecting arm 42 pivoted on an upper end to the slidable wedge 26, and on the other lower end, to the hinged arm end portion of the lever 24. The wedge 26 is thereby forcibly slid towards the upper end log restraint 30 when the lever 24 is swung down, and the wedge 26 is alternatively slid away from the upper end log restraint 30 when the lever 24 is swung back up.

In the most preferred aspect of this invention the log splitter 20 further comprises a bias 36, which most preferably is a spring 38, to lift the lever 24 to an upper position when downward force 16 is not applied to the lever 24. In the most preferred aspect of this invention a foot pedal 40 is attached to the swinging end portion of the lever 24 so that the lever 24 may be forced downwardly with one's foot 14.

Figure 2:
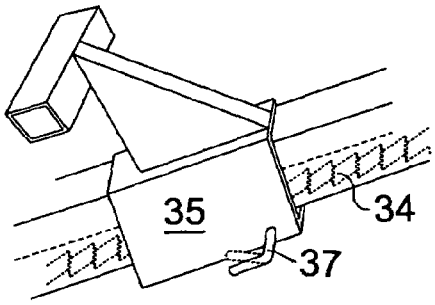
FIG. 2 is an enlarged perspective view of the upper end log restraint showing teeth along a bottom portion of the lever arm (the teeth are drawn in ghost).

FIG. 2 is an enlarged perspective view of the upper cut log restraint 30 showing teeth 34 along a bottom portion of the lever arm 24 (said teeth 34 are in ghost). Most preferably the lever 24 is made from a tubular member and has teeth 34 along a bottom side portion. In a preferred embodiment of the invention, said pawl 32 is carried by an interior upper side portion of a tubular sleeve 35 positioned over the lever 24. In the most preferred aspect of this invention the pawl 32 on the upper end log restraint 30 is attached to, and projects inwardly from an inner end portion of the upper end log restraint 30 so that the pawl 32 is coaxed into engagement with the teeth 34 when an upper portion of the upper end log restraint 30 resists the log 18.

Figure 3:
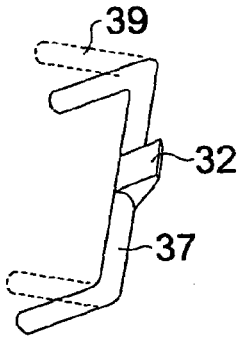
FIG. 3 is an enlarged perspective view of the pawl engagement/release pin partially shown in FIG. 2.

FIG. 3 is an enlarged perspective view of the engagement/release pin 37 partially shown in FIG. 2. In the most preferred embodiment of the invention pawl 32 is carried by the engagement/release pin 37. FIG. 3 shows pawl 32 in an engaged position. When an end portion 39 of the pin 32 is rotated upwardly as shown in ghost, pawl 32 disengages from teeth 34 shown on FIG. 2.

In a preferred aspect of this invention the log support 28 comprises two elongate members spaced 29 from, and positioned along and over the lever 24, so that the cut log 18 carried thereon will be generally split into equally sized portions by the wedge 26. Most preferably the elongate members 29 are carried and positioned by having a lower end portion thereof attached to the reciprocating wedge 26.

In the most preferred embodiment of the log splitter 20 the base 22 is also made from a tubular member. An end portion of the base 22 opposite that end portion which is hinged to the lever 24 further comprises a lateral tubular member 23 extending laterally to provide stability.

While the invention has been described with preferred specific embodiments thereof, it will be understood that this description is intended to illustrate and not to limit the scope of the invention, which is defined by the following claims.

We claim:

1. A log splitter for splitting a cut log comprising:

a) a base;

b) a lever having one end portion hingably attached to one end portion of the base and said lever having an opposite swinging end portion;

c) a wedge slidably attached to a hinged end portion of the lever configured to slidably reciprocate along the lever when the swinging end portion of the lever is swung down and up;

d) a log support carried by the lever to longitudinally support the cut log when the log is positioned thereon;

e) an upper end log restraint slidably positioned on the swinging end portion of the lever, said log restraint having a pawl, and the swinging end portion of the lever having teeth therealong to engage the pawl, so that the log restraint can slide along the lever only towards the cut log;

so that when the lever is swung down the wedge is forced into an end portion of the cut log, and when the lever is lifted the wedge is slidably pulled back along the lever thereby pulling the now partially split log down the lever so that the upper end log restraint freely slides down and along the lever; thereby positioning the wedge to advance further into the now partially split cut log when the lever is again pushed downwardly, repeating the cycle.

2. A log splitter as in claim 1 further comprising a bias to lift the lever to an upper position when downward force is not applied to the lever.

3. A log splitter as in claim 2 wherein the bias comprises a spring.

4. A log splitter as in claim 3 further comprising a foot pedal attached to the swinging end portion of the lever so that the lever may be forced downwardly with one's foot.

5. A log splitter as in claim 1 further comprising an interconnecting arm pivoted on an upper end to the slidable wedge, and on the other lower end to the hinged arm end portion of the lever, so that the wedge is thereby forcibly slid towards the upper end log restraint when the lever is swung down, and the wedge is alternatively slid away from the upper end log restraint when the lever is swung back up.

6. A log splitter as in claim 5 wherein the lever comprises a tubular member and has teeth along a bottom side portion, and wherein said pawl is attached to an interior upper side portion of a tubular sleeve positioned over the lever.

7. A log splitter as in claim 6 wherein the pawl on the upper end log restraint is attached to, and projects inwardly from an inner end portion of the upper end log restraint so that the pawl is coaxed into engagement with the teeth when an upper portion of the upper end log restraint resists the log.

8. A log splitter as in claim 1 wherein the log support comprises two elongate members spaced from, and positioned along and over the lever, so that the cut log carried thereon will be generally split into equally sized portions by the wedge.

9. A log splitter as in claim 8 wherein the elongate members are carried and positioned by having a lower end portion thereof attached to the reciprocating wedge.

10. A log splitter as in claim 1 wherein the base is made from a tubular member and wherein an end portion of the base opposite that end portion which is hinged to the lever further comprises a lateral tubular member to provide stability.

* * * * *